US008746670B2

(12) United States Patent
Boos

(10) Patent No.: US 8,746,670 B2
(45) Date of Patent: Jun. 10, 2014

(54) BUNDLE COMPOSED OF PRINTED PRODUCTS AND METHOD FOR PRODUCING THE BUNDLE

(75) Inventor: Konrad Boos, Stettfurt (CH)

(73) Assignee: Mueller Martini Holding AG, Hergiswil (CH)

( * ) Notice: Subject to any disclaimer, the term of this patent is extended or adjusted under 35 U.S.C. 154(b) by 156 days.

(21) Appl. No.: 13/530,895

(22) Filed: Jun. 22, 2012

(65) Prior Publication Data

US 2012/0326427 A1 Dec. 27, 2012

(30) Foreign Application Priority Data

Jun. 22, 2011 (CH) ..... 1061/11

(51) Int. Cl.

| | |
|---|---|
| ***B65H 29/00*** | (2006.01) |
| ***B65H 35/04*** | (2006.01) |
| ***B65H 45/04*** | (2006.01) |

(52) U.S. Cl.

CPC ..... *B65H 29/00* (2013.01); *B65H 2301/42146* (2013.01); *B65H 35/04* (2013.01); *B65H 45/04* (2013.01)

USPC ..... 270/58.17; 270/58.11; 270/58.12; 270/58.27; 270/52.09; 270/20.1; 270/21.1; 53/542; 53/529

(58) Field of Classification Search

CPC ..... B65B 35/56; B65B 61/24; B65B 61/26; B65H 29/00; B65H 2301/4317; B65H 2301/43; B65H 2301/42146; B65H 2301/42192; B65H 2301/4219; B65H 2301/3621

USPC ..... 270/52.16, 58.11, 58.12, 58.17, 58.27, 270/58.29; 271/181, 184; 53/445, 542, 529

See application file for complete search history.

(56) References Cited

U.S. PATENT DOCUMENTS

| | | | | |
|---|---|---|---|---|
| 3,518,940 A | | 7/1970 | Stroud et al. | |
| 3,690,474 A | * | 9/1972 | Klappenecker | 271/3.13 |
| 3,994,487 A | * | 11/1976 | Wicklund | 271/314 |
| 4,509,739 A | * | 4/1985 | Kurokawa | 271/176 |

(Continued)

FOREIGN PATENT DOCUMENTS

| | | |
|---|---|---|
| EP | 2098465 A1 | 5/2008 |
| EP | 1950159 A1 | 7/2008 |
| EP | 2159070 | 8/2008 |
| EP | 2070854 A2 | 6/2009 |

OTHER PUBLICATIONS

International Search Report—Oct. 7, 2011.
U.S. Appl. No. 13/462,473, filed May 2, 2012.

(Continued)

*Primary Examiner* — Leslie A Nicholson, III

(74) *Attorney, Agent, or Firm* — Venable LLP; Robert Kinberg

(57) ABSTRACT

A bundle of identical book blocks composed of a plurality of folded print sheets or signatures standing upright on lower edges of the printed sheets or book blocks. The book blocks are formed with first and last book block sections having different dimensions. A quadrangular bundle is formed from the book blocks by aligning first limit surfaces of the book block sections flush with each other along one of the two side surfaces or along the upper or lower surfaces of the bundle so that a second limit surface of the first book block section opposite the first limit surface of the first book block section projects with an offset with respect to a limit surface of the last book block section opposite the first limit surface of the last book block section. The bundle is compressed and then secured.

13 Claims, 4 Drawing Sheets

(56) References Cited

U.S. PATENT DOCUMENTS

| | | | | |
|---|---|---|---|---|
| 4,655,131 | A * | 4/1987 | Kramer | 101/236 |
| 4,940,219 | A | 7/1990 | Volat | |
| 5,218,813 | A | 6/1993 | Seidel | |
| 5,450,940 | A | 9/1995 | Rathert et al. | |
| 5,485,989 | A | 1/1996 | McCay et al. | |
| 5,515,667 | A | 5/1996 | Roosli | |
| 6,161,830 | A * | 12/2000 | Yap | 271/181 |
| 6,453,645 | B1 * | 9/2002 | Suokas et al. | 53/446 |
| 6,782,678 | B1 * | 8/2004 | Bodereau | 53/542 |
| 7,021,035 | B2 | 4/2006 | Muri et al. | |
| 2006/0290046 | A1 | 12/2006 | Sanmiya et al. | |

OTHER PUBLICATIONS

International Search Report issued in Application No. CH 10612011 dated Sep. 29, 2011.

Office Action in U.S. Appl. No. 13/462,473, dated Jan. 27, 2014.

* cited by examiner

BUNDLE COMPOSED OF PRINTED PRODUCTS AND METHOD FOR PRODUCING THE BUNDLE

CROSS-REFERENCE TO RELATED APPLICATION

This application claims the priority of Swiss Patent Application No. 01061/11, filed on Jun. 22, 2011, the subject matter of which is incorporated herein by reference.

BACKGROUND OF THE INVENTION

The invention relates to a bundle and a method for producing the bundle for which a plurality of print sheets or signatures are combined into a book block and for which a plurality of book blocks, having the same orientation and respectively positioned standing upright on the lower edges of the print sheets, are combined into a quadrangular-shaped bundle with two end faces and two side surfaces, as well as an upper and a lower surface. The book blocks are then compressed and are secured in position following the compressing. Bundles of this type are produced for the temporary storage of print sheets with the aid of so-called bundle delivery machines. For this, print sheets which are successively lined up while positioned upright are gathered, compressed, and then strapped together to form a bundle.

As is known, for the production of perfect-bound or adhesive-bound printed products such as books, paperback books and similar products, the required print sheets and covers are printed during a first step in an optional sequence and are then stored temporarily. The print sheets, for example identical or different type sheets which can also be folded individual sheets, single pages, inserts and supplements, fly leaves or sheets with glued-on fly leaves, are subsequently gathered in the correct sequence to form loose book blocks and are then supplied to a perfect binder to be bound along the spine and glued together with additional book components, such as covers, book cases for hardcover products, combination fly leaves or reinforcing strips. By separating the printing process from the binding process, each process can be realized with the correspondingly optimum speed. However, it has proven to be a disadvantage that the binding process can be carried out only if all print sheets and covers have already been printed, which requires a relatively large area for storing the print sheets and covers.

Also known are printing presses which sequentially print all pages of a book and subsequently deliver complete, loose book blocks that can be supplied directly to a perfect binder. A printing press of this type is known from the document U.S. Pat. No. 3,518,940. With this method, which is rarely used in practical operations, the temporary storage of print sheets can be avoided, but it also requires an extremely involved printing press. In addition, this method makes economic sense only for extremely large editions and the achievable print quality is low.

For some time now, digital printing presses have been known which sequentially print all pages of a book and then supply complete, loose book blocks that can be bound without requiring further operations. A digital printing press accordingly can be used to optionally produce sequentially-printed, complete book blocks which contain different contents. A further advantage of the digital printing press is that no printing plates are required. In addition to avoiding the costs of producing the printing plates, the interruptions in the operation required for replacing the printing plates are also omitted. The print sheets or individual pages that form a book block are delivered in the form of a stack, for example deposited in an offset arrangement on a pallet, so that they can be separated again easily later on. Alternatively, non-offset layers of book blocks can be formed, meaning these layers are stacked one above the other, by inserting intermediate layers for separating them. Book blocks stacked in this way can be stored for an optional length of time before being supplied to a perfect binder.

The stacking of the loose stacks on the pallets can either be carried out manually or automatically, with the aid of a so-called palletizer. A device of this type is disclosed in European patent document EP 2098465 A1. The loose sheet stacks of horizontally positioned printed products are removed again manually from the pallet at a later time and are supplied to the feeding region of a perfect binder. However, this solution has the known disadvantage that the loose book blocks are not sufficiently compressed along the fold region, thereby resulting in products which are considerably thicker in the fold region than in the flat region. In addition, the book blocks on the bottom are compressed most and the top ones are not compressed at all. Poorly compressed book blocks or differently strong compressed book blocks can lead to serious problems during the further processing or can hinder the further processing.

European patent document EP 2159070 A1 proposes gluing together the print sheets in a stack along one edge region. As a result, the stacks can be separated again clearly at a later point in time, prior to the further processing. With this method, however, the print sheets are also compressed irregularly or insufficiently, thereby again resulting in the previously mentioned disadvantages. The glued together print sheets furthermore can no longer be aligned, relative to each other, in the perfect binder. A further disadvantage is that the surface area of the print sheets which is necessary for the gluing and which must then be cut off in a three-knife trimmer during the final trimming step considerably increases the use of paper. An additional disadvantage is the thickening of the stack in those locations where adhesive is applied to the print sheets, thereby making the further processing more difficult.

Also known is a method of gluing the print sheets together along the front ends rather than between the flat areas. Besides the above-mentioned disadvantages of such a gluing operation, this method has the further disadvantage that glue can be deposited along the paper guides during the further processing, thereby causing machine malfunctions and necessitating the expense of a cleaning operation.

Instead of depositing the stacks of print sheets on pallets or similar devices, methods are furthermore known for which the printing press is arranged and operated in line with the perfect binder. Since the printing press can print continuously, as previously mentioned, a buffer or storage section must be provided between the printing press and the further processing locations, wherein the buffer capacity must be sufficient for the individual storage of the book blocks which are printed during the period of changeover to the further processing operations. Additional buffer capacity should also be provided in case the further processing operation stops for any reason whatsoever. Alternatively, the book blocks printed during such an interval can also be transferred out and can then be re-supplied at a later time.

The European patent document EP 1950159 A1 discloses a stack-type arrangement of flat printed products, wherein all printed products within the stack have the same orientation. One of the four sides of the printed products is thicker than the other sides, for example because the printed products have a fold or even a staple on this side. To ensure that these stacks have the same stability as the stacks composed of partial stacks which are arranged offset to each other by 180°, the partial stacks in this case are arranged so as to alternate the thicker sides. In the process, the partial stacks are offset perpendicular to the lower edges, in the direction of the stack height. Stacks configured in this way have the disadvantage that the printed products within the stack are compressed differently strong in the region of the thicker side, thereby causing the non-compressed fold regions to have a tendency to fan out.

SUMMARY OF THE INVENTION

It is an object of the present invention to provide a method for which the gathered book blocks are stacked so that they are compressed uniformly during the storage and can be separated again clearly for further processing, wherein the storage and buffering of the book blocks should require as little room as possible. This method of stacking the book blocks should furthermore be usable for the inline as well as for the offline operation of the printing press and the perfect binder line.

The above and other objects are achieved according to the invention by the provision of a method for producing a bundle composed of identical book block respectively including a plurality of print sheets or signatures standing upright on lower edges of the print sheets or signatures, wherein in one embodiment the method includes: forming the book blocks with at least a first book block section and a last book block section having different dimensions from the first book block section and wherein the book block sections respectively have limit surfaces on the side surfaces or the upper or lower surfaces of the bundle to be formed; forming a quadrangular bundle from the book blocks having two end faces, two side surfaces and an upper and a lower surface, by aligning first limit surfaces of the book block sections flush with each other along one of the two side surfaces or along the upper or lower surfaces of the bundle so that a second limit surface of the first book block section which is arranged opposite the first limit surface of the first book block section projects with an offset with respect to a limit surface of the last book block section that is arranged opposite the first limit surface of the last book block section; compressing the aligned book blocks of the bundle; and securing the position of the compressed book blocks in the bundle.

The side limit surfaces of at least thin book block sections can also be called side edges. When using this method, clear locations of separation develop as a result of the side offset from book block to book block, created within the resulting bundle, wherein these separation locations make it possible to securely separate the loose book blocks again at a later time. A method for storing the book blocks in this way, taking the form of a bundle, can ensure that all book blocks and print sheets are compressed with the same force and that no deformations of individual book blocks occur until the book blocks are removed again at a later point in time, for example just prior to the further processing.

According to another aspect of the invention, there is provided a bundle, which in one embodiment includes: a plurality of identical book blocks respectively including a plurality of print sheets or signatures, wherein the book blocks are aligned with the same orientation and respectively positioned upright on lower edges of the print sheets or signatures in a compressed and secured quadrangular bundle, the bundle having two end faces, two side surfaces and an upper and a lower surface, wherein the book blocks comprise at least a first book block section and a last book block section having a different dimensions from the first book block, wherein the book block sections respectively have a limit surface on the side surfaces or the upper or the lower surface of the bundle, and wherein first limit surfaces are oriented flush with each other along one of the two side surfaces or at the upper or the lower surface so that a second limit surface of the first book block section, which is opposite the first limit surface of the first book block section, projects offset relative to a limit surface of the last book block section which is opposite the first limiting section of the last book block section.

In various embodiments, different dimensions for the book block sections with different formats (i.e. dimensions) are obtained by cutting sections from a printed material web which are then folded differently, or by cutting differently long sections from the printed material web which are then folded. The book block sections with different formats can also be produced in that prior to the folding operation, the sections cut from a printed material web, with the aid of a cyclically adjustable alignment element, are arranged offset, transverse to a movement direction of the printed material web. The leg length of the folded sections can thus be changed, depending on the requirement.

In another embodiment the book blocks are gathered and the bundle is formed so that the folding edges of the print sheets are used as the lower edges. With folded print sheets or signatures, it is particularly advantageous if the folded edge, produced last during the course of a folding operation and referred to as "last folded edge," is used as the lower edge since it has the highest mechanical load capacity.

According to another embodiment of the invention, the book blocks in the bundle can respectively be formed with print sheets having different types of print contents. In that case, the print sheets are supplied by a digital printing press, for example, which can optionally produce complete book blocks with successively printed pages and having differing contents.

With the methods described herein, bundles composed of book blocks can be produced for which the book blocks are formed with at least a first and a last book block section having a different format, wherein the book block sections are provided with respectively one limit surface on the side surfaces or the upper or the lower surface of the bundle to be formed and wherein the first limit surfaces of the book block sections are oriented so as to be aligned with each other at one of the two side surfaces or the upper or the lower surface of the bundle. According to the invention, a second limit surface of the first book block section, which is arranged opposite the first limit surface of the first book block section for such a bundle, projects so as to be offset relative to a limit surface of the last book block section that is arranged opposite the first limit surface of the last book block section.

The lower edges are advantageously formed by the folded edges, in particular a last folded edge of the print sheets contained in the bundle. If the book blocks in the bundle are respectively formed with print sheets that can be printed by a digital printing press and can contain different contents, the individual book blocks in the bundle can also have a different print content.

According to yet another embodiment of the bundle according to the invention, the book blocks composed of gathered print sheets can also contain different components of a book such as inserts or supplements, fly leaves or sheets with glued-on fly leaves.

In yet another embodiment the print sheets and/or the book blocks and/or the bundles are provided with at least one information carrier for the identification. As a result, an individual processing operation can be assigned either to each individual bundle or its components during the further processing.

BRIEF DESCRIPTION OF THE DRAWINGS

These and other features and advantages of the invention will be further understood from the following detailed description of the preferred embodiments with reference to the accompanying drawings, wherein.

DETAILED DESCRIPTION OF EMBODIMENTS

Figure 1A:
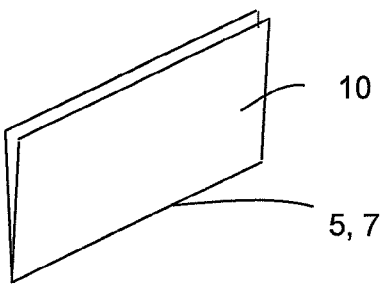
FIG. 1*a* shows a single print sheet.
Figure 1:
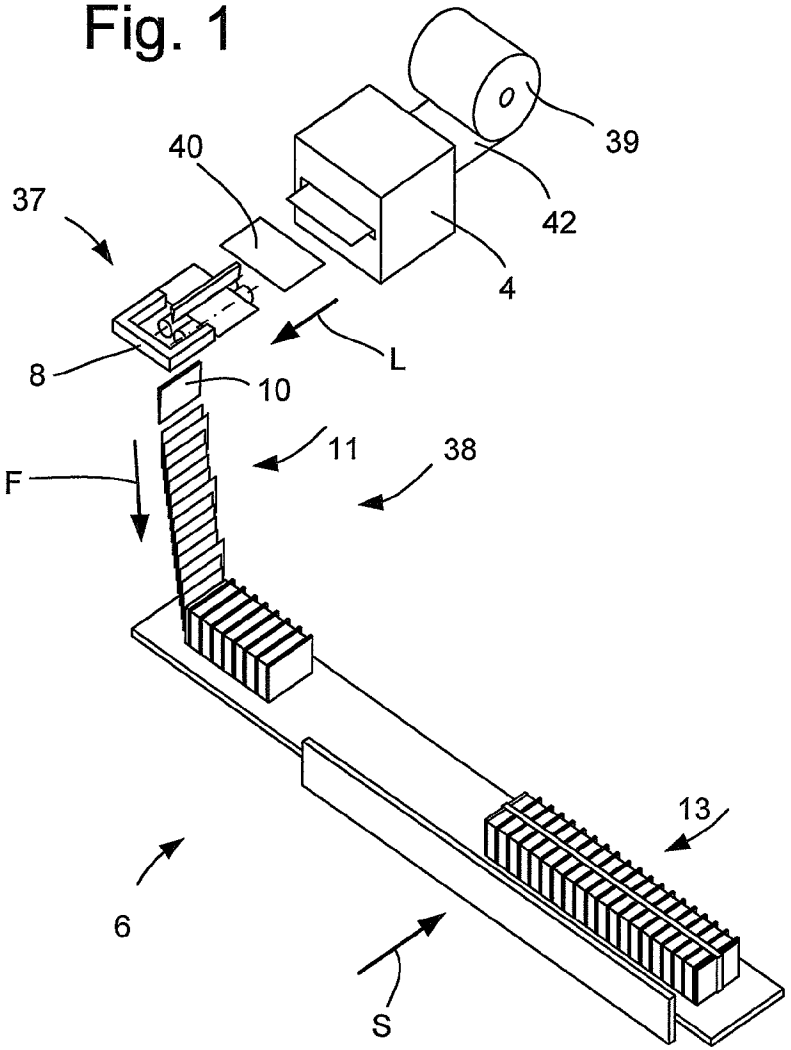
FIG. 1 is a schematic perspective representation of a method according to the invention for producing a bundle (print sheets have different lengths)

FIG. 1 shows an exemplary embodiment of a bundle former 6 with upstream-arranged printing press 4. The printing press 4, for example a digital printing press, prints the content onto a material web 42 which unwinds from a paper roll 39, in the sequence in which the book is composed, wherein the web is then cut into sections 40 after the printing operation. These sections 40, which are also called print sheets, can be delivered in the form of an overlapping flow 11, either as non-folded sheets 10 or as signatures which are folded in a folding mechanism 37. The print sheets 10 have a lower edge 7, which can be a folding edge 5, as shown in FIG. 1*a*.

The folding mechanism 37 shown in FIG. 1 takes the form of a sword-type folding mechanism, meaning the sections 40 are conveyed between two folding rollers with the aid of a sword and are folded by these rollers. The different formats for the sections 40 can be achieved in that differently long sections 40 are cut from the material web or that the sections 40 are folded differently.

Figure 3:
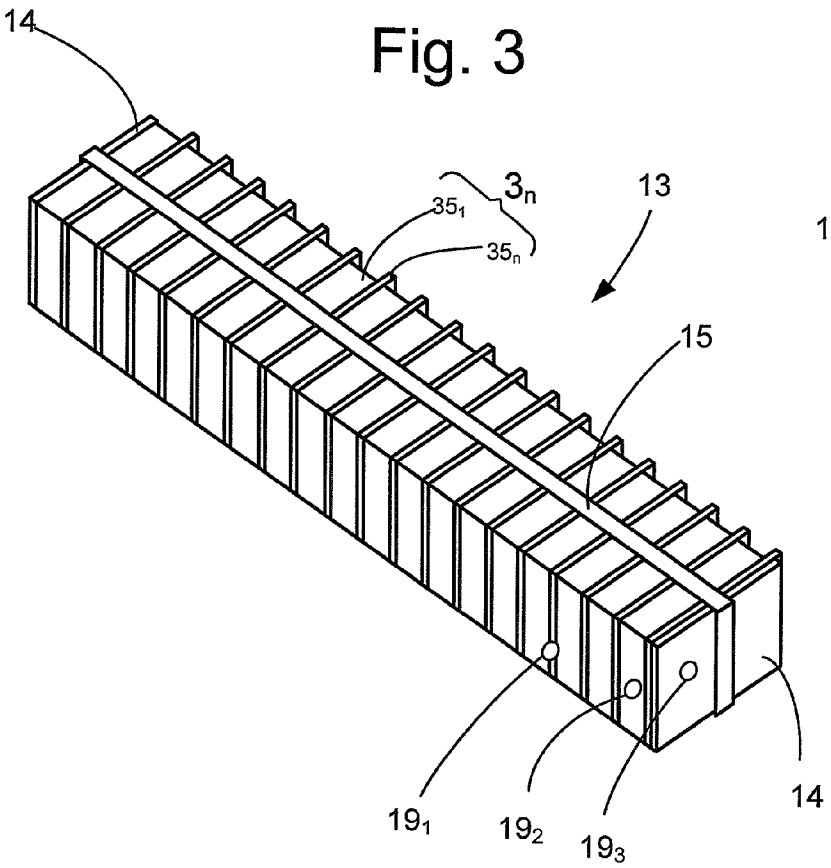
FIG. 3 shows a perspective view of a bundle composed of book blocks (print sheets have different lengths)

FIG. 1 shows that differently long sections 40 are cut in movement direction L which are then aligned against a fixed end stop 8 prior to the folding operation. The longer sections 40 subsequently project on the side opposite the end stop 8 from the overlapping flow 11 and from the bundle 13, thus resulting in a bundle of the type as shown in FIG. 3. FIG. 3 shows, for example, that information carrier $\mathbf{19}_1$, $\mathbf{19}_2$ and $\mathbf{19}_3$ are contained in the bundle 13, which are used for the identification of the print sheets or signatures 10 and/or the book blocks $\mathbf{3}_{1\ldots n}$ and/or the bundles 13, depending on where these information carriers are attached.

Figure 2:
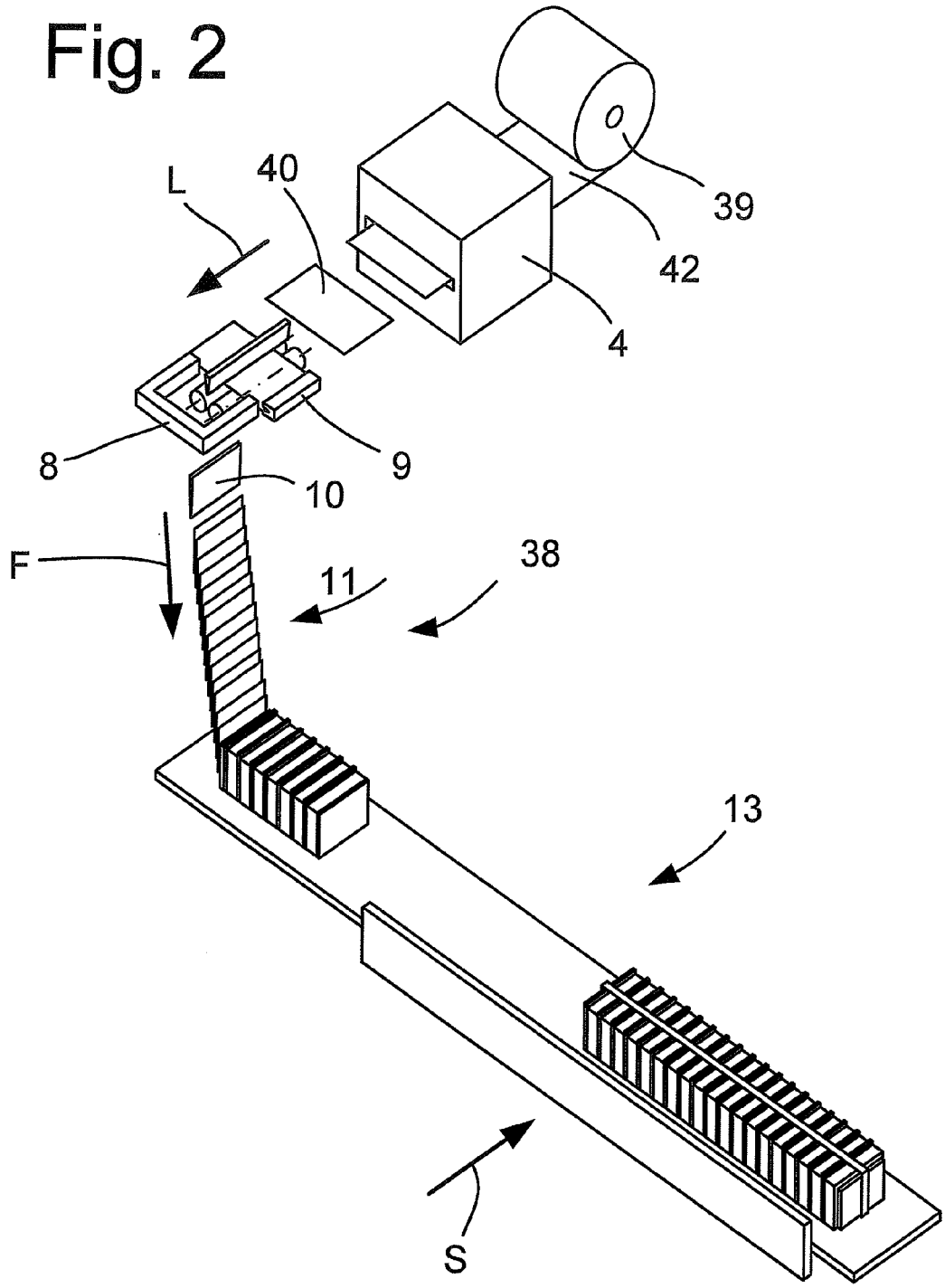
FIG. 2 is a schematic perspective representation of a variant of the method according to the invention for producing a bundle (print sheets are folded differently)
Figure 4:
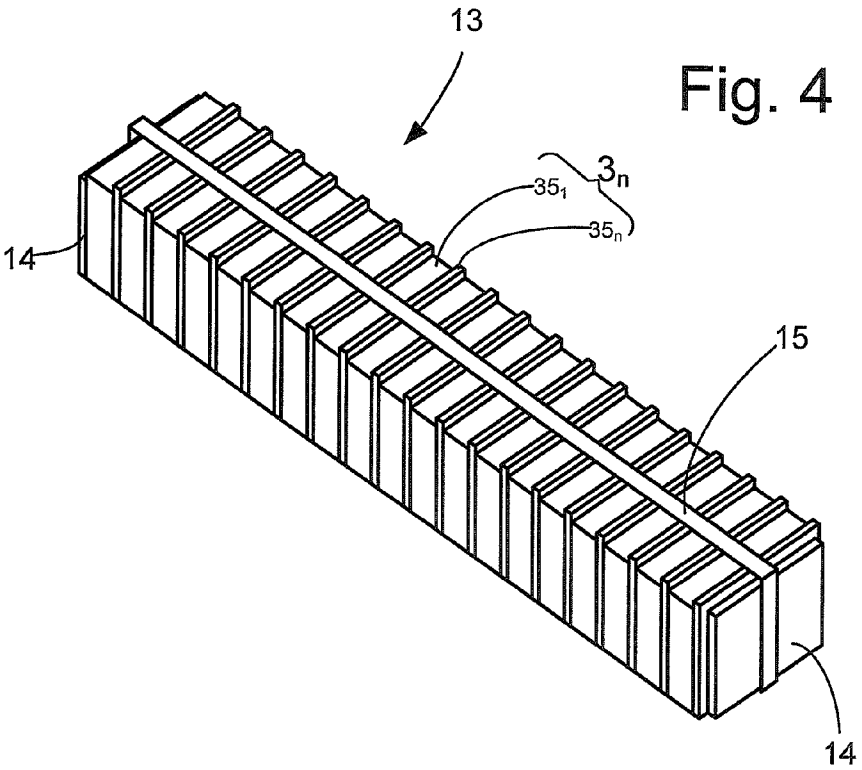
FIG. 4 shows another embodiment of a bundle composed of book blocks (print sheets are folded differently)

According to FIG. 2, the sections 40 are deposited prior to the folding in an offset arrangement transverse to the movement direction L with the aid of a cyclically adjustable alignment element 9, thus making it possible to change the leg length of the sections 40 which are folded into print sheets or signatures 10. A bundle 13 composed of sections 40, folded in this way, is shown in FIG. 4.

The overlapping flow 11 is conveyed in conveying direction F with a conveyor 38 to the bundle former 6 where the sheets are stacked into a bundle 13, which is then provided with end boards 14, is compressed with an adjustable force and is strapped with a traction element 15. The pressing force is maintained inside the strapped bundles 13, meaning that all signatures 10 inside the bundle continue to be compressed with the same force. As a result of the compressing, the spring-back of the book blocks $\mathbf{3}_{1\ldots n}$ in the region of the fold is reduced considerably when the traction element 15 is released, thereby making it possible to achieve a higher product quality during the further processing of the book blocks $\mathbf{3}_{1\ldots n}$ since deformations of the book blocks $\mathbf{3}_{1\ldots n}$ cannot occur any longer. Bundle former 6 can be a generic device, for example the device disclosed in the European patent document EP 623542 A1. A slider 16 subsequently pushes the strapped bundle 13 in the pushing direction S, for example onto a buffering section.

Other devices can conceivably also be used in place of the end boards 14 and the traction elements 15 to compress and stabilize the bundles 13. For example, the bundles 13 can be held together and compressed with the aid of reusable clamps, wherein the clamps could then be returned automatically or manually to the bundle former 6, following the opening of the clamps.

Figure 5:
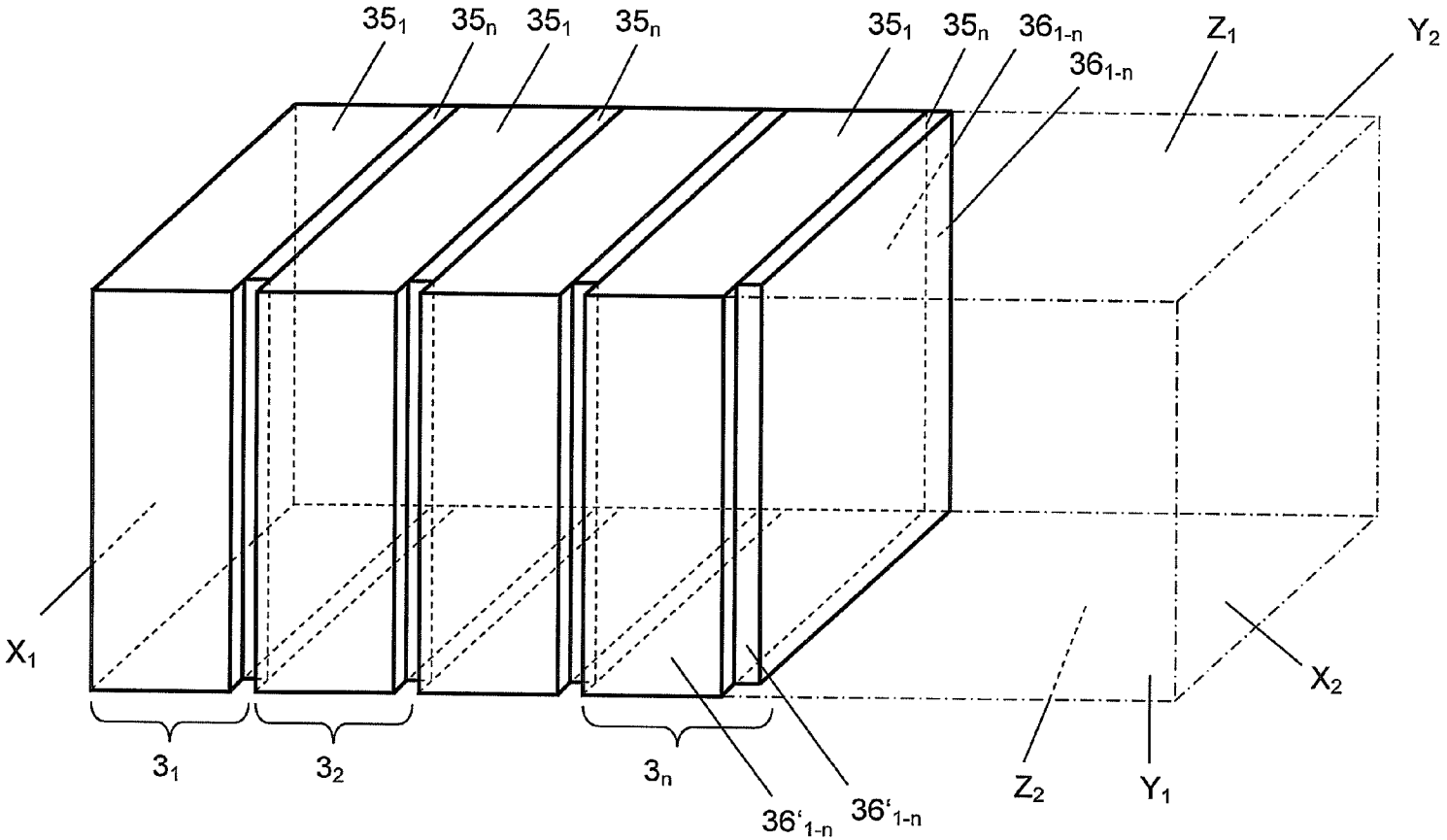
FIG. 5 shows an enlarged representation of a bundle formed with partial book blocks.

FIG. 5 shows the basic configuration of a bundle 13, composed of identical book blocks $\mathbf{3}_{1\ldots n}$, meaning they are identical from the point of view of the format sequence of all print sheets or signatures 10 involved, for which several of these print sheets 10 are combined into a single book block $\mathbf{3}_{1\ldots n}$. A plurality of book blocks $\mathbf{3}_{1\ldots n}$ with the same orientation and respectively positioned upright on the lower edges 7 of the print sheets 10 are combined to form a quadrangular bundle 13 with two end faces $x_1$, $x_2$, two side surfaces and $y_1$, $y_2$, as well as with an upper and a lower surface $z_1$, $z_2$, and are then compressed. The book blocks $\mathbf{3}_{1\ldots n}$ are formed with at least a first book block section $\mathbf{35}_1$ and a last book block section $\mathbf{35}_n$ having different formats. The book block sections $\mathbf{35}_{1\ldots n}$ have respectively one limit surface $\mathbf{36}_{1\ldots n}$ at the side surfaces $y_1$, $y_2$, or the upper or the lower surface $z_1$, $z_2$ of the bundle 13 to be formed, wherein the first limit surfaces $\mathbf{36}_{1\ldots n}$ of the book block sections $\mathbf{35}_{1\ldots n}$ are aligned flush with each other along one of the two side surfaces $y_1$, $y_2$ or the upper or the lower surface $z_1$, $z_2$. A second limit surface $\mathbf{36'}_{1\ldots n}$ of the first book block section $\mathbf{35}_1$ that is arranged opposite the first limit surface $\mathbf{36}_{1\ldots n}$ of the first book block section $\mathbf{35}_1$ in this case projects, such that it is offset relative to a limit surface $\mathbf{36'}_{1\ldots n}$ of the last book block section $\mathbf{35}_n$ that is arranged opposite the first limit surface $\mathbf{36}_{1\ldots n}$ of the last book block section $\mathbf{35}_n$.

It will be understood that the above description of the present invention is susceptible to various modifications, changes and adaptations, and the same are intended to be comprehended within the meaning and range of equivalents of the appended claims.

What is claimed is:

1. A method for producing a bundle composed of identical book blocks respectively including a plurality of print sheets or signatures standing upright on lower edges of the print sheets or signatures, comprising:

forming the book blocks with at least a first book block section and a last book block section having different dimensions from the first book block section and wherein the book block sections respectively have limit surfaces on the side surfaces or the upper or lower surfaces of the bundle to be formed;

forming a quadrangular bundle from the book blocks having two end faces, two side surfaces and an upper and a lower surface, by aligning first limit surfaces of the book block sections flush with each other along one of the two side surfaces or along the upper or lower surfaces of the bundle so that a second limit surface of the first book block section which is arranged opposite the first limit surface of the first book block section projects with an offset with respect to a limit surface of the last book block section that is arranged opposite the first limit surface of the last book block section;

compressing the aligned book blocks of the bundle; and securing the position of the compressed book blocks in the bundle.

2. The method according to claim 1, further including cutting the book block sections from a printed material web and folding the at least first and last sections differently to obtain the book block sections with different dimensions.

3. The method according to claim 1, further including cutting differently long sections from the printed material web and subsequently folding the differently long sections to obtain the book block sections with different dimensions.

4. The method according to claim 1, further including cutting the printed material web into cut sections with a cyclically adjustable element; depositing the cut sections in an offset arrangement in a direction transverse to a movement direction; and folding the offset cut sections to form the book block sections with different dimensions.

5. The method according to claim 1, wherein the print sheets or signatures have folded edges, and the method further includes forming the bundle so that the folded edges of the print sheets or signatures are the lower edges.

6. The method according to claim 5, including forming the bundle so that respectively a last folded edge of the print sheets or signatures is used as the lower edge.

7. The method according to claim 1, including forming the respective book blocks in the bundle formed with print sheets or signatures having different print content.

8. A bundle, comprising:

a plurality of identical book blocks respectively including a plurality of print sheets or signatures, wherein the book blocks are aligned with the same orientation and respectively positioned upright on lower edges of the print sheets or signatures in a compressed and secured quadrangular bundle, the bundle having two end faces, two side surfaces and an upper and a lower surface, wherein the book blocks comprise at least a first book block section and a last book block section having a different dimensions from the first book block, wherein the book block sections respectively have a limit surface on the side surfaces or the upper or the lower surface of the bundle, and wherein first limit surfaces are oriented flush with each other along one of the two side surfaces or at the upper or the lower surface so that a second limit surface of the first book block section, which is opposite the first limit surface of the first book block section, projects offset relative to a limit surface of the last book block section which is opposite the first limiting section of the last book block section.

9. The bundle according to claim 8, wherein the lower edges of the print sheets or signatures in the bundle comprise folded edges.

10. The bundle according to claim 9, wherein respectively one last folded edge of the print sheets or signatures in the bundle comprises the lower edge.

11. The bundle according to claim 8, wherein the book blocks in the bundle respectively have print sheets or signatures with different print content.

12. The bundle according to claim 8, wherein the book blocks further include at least one of inserts and supplements, fly leaves and sheets with glued-on fly leaves.

13. The bundle according to claim 8, wherein the print sheets or signatures and/or the book blocks and/or the bundles include at least one information carrier for identification.

* * * * *